US009803402B2

(12) United States Patent
Ichikawa et al.

(10) Patent No.: US 9,803,402 B2
(45) Date of Patent: Oct. 31, 2017

(54) VEHICULAR HANDLE DEVICE

(71) Applicant: Alpha Corporation, Yokohama-shi, Kanagawa (JP)

(72) Inventors: Shinji Ichikawa, Yokohama (JP); Shuichi Kudoh, Yokohama (JP)

(73) Assignee: ALPHA CORPORATION, Kanagawa (JP)

( * ) Notice: Subject to any disclaimer, the term of this patent is extended or adjusted under 35 U.S.C. 154(b) by 316 days.

(21) Appl. No.: 14/383,114

(22) PCT Filed: Mar. 26, 2013

(86) PCT No.: PCT/JP2013/058670
§ 371 (c)(1),
(2) Date: Sep. 5, 2014

(87) PCT Pub. No.: WO2013/153947
PCT Pub. Date: Oct. 17, 2013

(65) Prior Publication Data

US 2015/0061304 A1 Mar. 5, 2015

(30) Foreign Application Priority Data

Apr. 10, 2012 (JP) ..... 2012-089399

(51) Int. Cl.
*E05C 19/06* (2006.01)
*E05B 85/16* (2014.01)
(Continued)

(52) U.S. Cl.
CPC ..... *E05B 85/16* (2013.01); *E05B 79/06* (2013.01); *E05B 7/00* (2013.01); *E05B 85/10* (2013.01); *E05B 85/14* (2013.01); *Y10T 292/57* (2015.04)

(58) Field of Classification Search
CPC ..... E05B 7/00; E05B 85/10; E05B 85/14
(Continued)

(56) References Cited

U.S. PATENT DOCUMENTS 785,380 A * 3/1905 Ripson ..... E05C 19/06 220/783
4,550,230 A * 10/1985 Johnson ..... H04R 1/023 181/199
(Continued)

FOREIGN PATENT DOCUMENTS

JP 58-78357 U 5/1983
JP 08-021423 A 1/1996
(Continued)

OTHER PUBLICATIONS

Official Communication issued in International Patent Application No. PCT/JP2013/058670, dated Jun. 25, 2013.

*Primary Examiner* — Carlos Lugo
(74) *Attorney, Agent, or Firm* — Keating and Bennett, LLP

(57) ABSTRACT

A vehicular handle device includes: a handle base fixed to a vehicle and holding an operating handle; and a shaft component inserted into and attached to a bearing portion provided in the handle base. The shaft component is retained in the bearing portion while being restrained from moving in a slipping-out direction by a cantilever-shaped elastic piece formed on the handle base and configured to be elastically deformed to allow passage of the shaft component. The handle base is provided with a stopper protrusion portion which limits an elastic deformation range of the elastic piece by letting a free end portion of the elastic piece abut on a stopper surface.

6 Claims, 5 Drawing Sheets

(a)

(b)

(51) Int. Cl.

| | |
|---|---|
| ***E05B 79/06*** | (2014.01) |
| *E05B 3/00* | (2006.01) |
| *E05B 85/10* | (2014.01) |
| *E05B 7/00* | (2006.01) |
| *E05B 85/14* | (2014.01) |

(58) Field of Classification Search
USPC ..... 292/80, 81, 87, 336.3
See application file for complete search history.

(56) References Cited

U.S. PATENT DOCUMENTS

| | | | | | |
|---|---|---|---|---|---|
| 4,838,590 | A * | 6/1989 | Isomura | E05B 85/12 | 292/336.3 |
| 5,011,202 | A * | 4/1991 | Kato | B41J 3/54 | 292/336.3 |
| 5,100,015 | A * | 3/1992 | Vanderstuyf | B65D 50/045 | 220/324 |
| 5,577,779 | A * | 11/1996 | Dangel | E05C 19/06 | 220/326 |
| 5,583,612 | A * | 12/1996 | Schell | E05C 3/14 | 292/80 |
| 6,036,244 | A * | 3/2000 | Tyves | E05B 85/12 | 292/336.3 |
| 6,363,577 | B1 * | 4/2002 | Spitzley | E05B 79/06 | 16/438 |
| 7,189,043 | B2 * | 3/2007 | Benoit | F16B 41/002 | 24/669 |
| 8,020,901 | B2 * | 9/2011 | Watanabe | B41J 29/00 | 292/80 |
| 8,777,281 | B2 * | 7/2014 | Saitou | E05B 79/06 | 292/336.3 |
| 2011/0042973 | A1 * | 2/2011 | Yoshino | E05B 79/06 | 292/336.3 |
| 2011/0080010 | A1 | 4/2011 | Gouhara et al. | | |

FOREIGN PATENT DOCUMENTS

| | | | | |
|---|---|---|---|---|
| JP | 09-078897 | A | 3/1997 | |
| JP | 2007-097339 | A | 4/2007 | |
| JP | 2007-101085 | A | 4/2007 | |
| JP | 2011-080254 | A | 4/2011 | |
| JP | 2011-256654 | A | 12/2011 | |
| WO | WO 2013076224 | A1 * | 5/2013 | E05B 77/04 |

* cited by examiner (a)

(b)

VEHICULAR HANDLE DEVICE

TECHNICAL FIELD

The present invention relates to a vehicular handle device.

BACKGROUND ART

A handle device disclosed in Patent Document 1 has been known as a vehicular handle device including a shaft component attached to a handle base holding an operating handle. In this conventional example, the handle is attached around a pin (shaft component) to a base member (handle base) of the handle device. The shaft component has a wide-diameter portion at one end. When the other end of the shaft component is inserted as an insertion leading end through a supporting hole of a pin supporting portion, restraining walls (elastic pieces) arranged in front of the pin supporting portion are temporarily deformed to allow the passage of the shaft component and are then restored to their original positions. Thereafter, the restraining walls restrain the shaft component from moving in a slipping-out direction.

PRIOR ART DOCUMENT

Patent Document

Patent Document 1: Japanese Patent Application Publication No. 2011-80254

SUMMARY OF THE INVENTION

Problems to be Solved by the Invention

However, in the above-mentioned conventional example, if the shaft component in a tilted posture is guided to the pin supporting portion, or if a prying force is applied when the shaft component is inserted, or in the like case, the elastic pieces may be deformed beyond an elastic range and to have a fracture, and this fracture causes the shaft component to come off or become unmountable or causes the like problem.

In particular, when the elastic piece is formed so as to be easily deformed in order to enhance ease of inserting operation of the shaft component, fracture strength is also prone to become low, and thus, there is a greater need for measures against fracture.

The present invention has been made in order to eliminate the foregoing drawbacks. An object of the present invention is to provide a vehicular handle device capable of preventing a fracture in an elastic piece, thereby ensuring that a shaft component is prevented from coming off or becoming unmountable.

Means for Solving the Problem

According to the present invention, the above object is attained by providing a vehicular handle device including: a handle base 2 fixed to a vehicle and holding an operating handle 1; and a shaft component 4 inserted into and attached to a bearing portion 3 provided in the handle base 2, in which the shaft component 4 is retained in the bearing portion 3 and is restrained from moving in a slipping-out direction by a cantilever-shaped elastic piece 5 formed on the handle base 2 and configured to be elastically deformed to allow passage of the shaft component 4, and the handle base 2 is provided with a stopper protrusion portion 7 which limits an elastic deformation range of the elastic piece 5 by letting a free end portion of the elastic piece 5 abut on a stopper surface 6.

The vehicular handle device includes the handle base 2 fixed to the vehicle in order to hold the operating handle 1, and the shaft component 4 fixed to the handle base 2. The shaft component 4 may be a pivot shaft of the operating handle 1 or a rotational operating component other than the operating handle 1, or may be merely an extended shaft member.

When the shaft component 4 is inserted into the bearing portion 3, the elastic piece 5 is temporarily elastically deformed to allow the passage of the shaft component 4. Upon completion of the inserting operation of the shaft component 4, the elastic piece 5 is restored to its original position, and the elastic piece 5 in the restored position interferes with a path of slipping-out of the shaft component 4 to prevent the slipping-out of the shaft component 4.

In the present invention in which the stopper protrusion portion 7 which limits the elastic deformation range of the elastic piece 5 is provided, even if the shaft component 4 is obliquely inserted or even in the like case, an excessive stress does not occur in the elastic piece 5, so that an inadvertent fracture in the elastic piece 5 can be prevented with reliability.

Also, the handle device may be configured as given below; specifically, the elastic piece 5 is arranged in such a manner that its opposed side edges are sandwiched between upstanding walls 8, and the stopper protrusion portion 7 is arranged at a position not overlapping a free end of the elastic piece 5 in a natural posture, as viewed in a standing direction of the upstanding walls 8.

As illustrated in FIG. 6, the opposed side edges of the elastic piece 5, or equivalently, side edges of the elastic piece 5 next to the free end edge thereof, are sandwiched between the upstanding walls 8 thereby to ensure that the elastic piece 5 can be protected from a load caused by other components colliding with the elastic piece 5 from its lateral side (in a direction of arrow F in Part (a) of FIG. 6), or the like. Also, the provision of the upstanding walls 8 requires that parting in a corresponding part of a mold for use in injection molding of the handle base 2 be set in a direction along the upstanding walls 8 (in a direction of arrow P in Parts (c) and (d) of FIG. 6) in order to prevent an undercut from appearing; in this case, a region U indicated by hatching in Part (a) of FIG. 6 forms an undercut region, and thus, there arises a need to arrange a core or the like in the mold in order to form the undercut region (U), and hence the mold becomes complicated in structure.

Meanwhile, as illustrated in Part (b) of FIG. 6, when the stopper protrusion portion 7 is arranged in such a manner that a gap (δ) is formed between the stopper protrusion portion 7 and a leading end of the elastic piece 5 in the natural posture without deformation, the stopper protrusion portion 7 can be arranged without the undercut region (U) appearing, which in turn eliminates the need to arrange the core or the like for eliminating the undercut in the mold, thus enabling a simplification of the structure of the mold.

The elastic piece 5 can overlap the stopper protrusion portion 7, provided only that the stopper surface 6 of the stopper protrusion portion 7 is arranged at a position where the stopper surface 6 interferes with a locus of the elastic piece 5. However, the handle device may be configured so that a distance between a proximal end of the elastic piece 5 and an insertion line of the shaft component 4 has a larger dimension than a distance between the stopper surface 6 and the insertion line of the shaft component 4. Thereby, as illustrated in FIG. 7, an interference range of the locus of the leading end of the elastic piece 5 with the stopper surface 6, or equivalently, an area of the elastic piece 5 to overlap the stopper surface 6, is increased by d, and thus, the reliability of the stopper protrusion portion 7 can be improved.

Note that, in FIG. 6, a white circle represents a proximal end of elastic deformation of the elastic piece 5.

In this case, the vehicular handle device may be configured as given below; specifically, the elastic piece 5 includes an oblique portion 9 to which the free end belongs, and which extends obliquely to the insertion line of the shaft component 4, and an orthogonal proximal end portion 10 extending from a proximal end of the oblique portion 9 to be substantially orthogonal to the insertion line of the shaft component 4. Thereby, the position of the proximal end of deformation can be lowered without a need to increase a length of the elastic piece 5, and thus, the elastic piece 5 can be arranged in a narrow region. FIG. 7 is a view of assistance in explaining operation of this configuration, Part (a) indicates that the elastic piece 5 configured as a straight beam is required to increase its length by (L) in order to lower the proximal end of elastic deformation by m for the purpose of ensuring the same increase d in an overlap allowance, and Part (b) indicates that the elastic piece 5 formed in a bent shape enables eliminating a need to increase an overall length and increasing an overlap dimension on the stopper surface 6 by (D).

Effect of the Invention

According to the present invention, a shaft component can be prevented with reliability from coming off or becoming unmountable.

MODE FOR CARRYING OUT THE INVENTION

Figure 1:
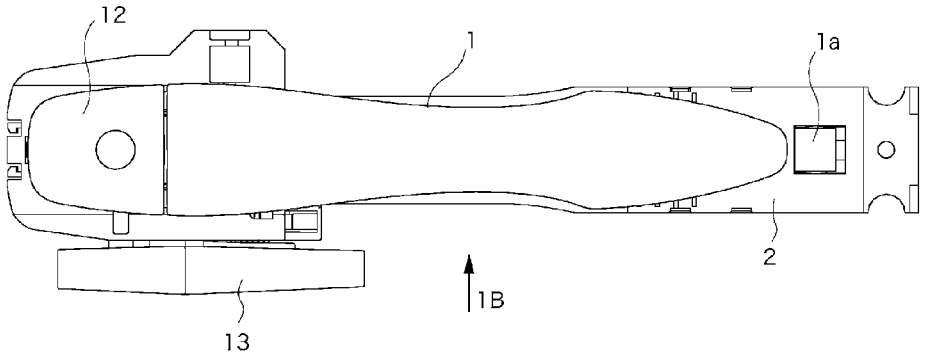
FIG. 1 is a view illustrating the present invention, Part (a) is a plan view, and Part (b) is a view taken in a direction of arrow 1B of Part (a).
Figure 1:
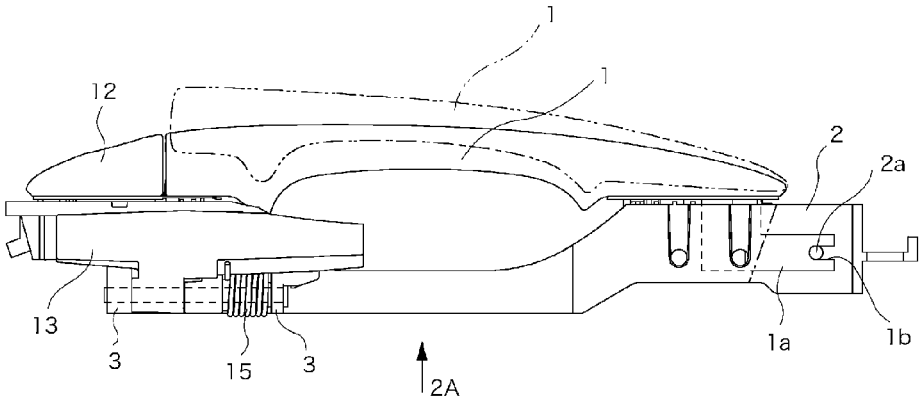

As illustrated in FIG. 1 and the following figures, a handle device includes a handle base 2 manufactured by injection molding a synthetic resin material and fixed to a door panel (not illustrated), and an operating handle 1 linked to the handle base 2.

As illustrated in Part (b) of FIG. 1, the operating handle 1 has a hinged leg 1*a* in one end portion, and the operating handle 1 is linked to the handle base 2 in such a way as to be turnable around a fitting portion as a center of rotation, by fitting a recess portion lb of the hinged leg 1*a* over a hinge protrusion portion 2*a* formed on the handle base 2. A stopper block 12 is linked to the handle base 2 in order to restrain the operating handle 1 from moving in a direction in which the fitting of the operating handle 1 with the hinge protrusion portion 2*a* is released.

Mounting of the handle device to a door is accomplished by fixing the handle base 2 along an inner wall of the door panel, then linking the operating handle 1 to the handle base 2 from an outer side of the door, and then linking the stopper block 12 to the handle base 2 from the outer side of the door.

Also, a relay lever 11 and a counter weight 13 are rotatably linked to the handle base 2 around a pivot shaft (a shaft component 4) arranged across bearing portions 3 in the form of protruding pieces. The relay lever 11 has an input portion 11*a* and an output portion 11*b*, the input portion 11*a* formed in an arm shape is locked to a locking portion 1*c* formed on one end of the operating handle 1, and the output portion 11*b* is linked via a cable device or the like to a door lock device 14 arranged in the door.

Figure 3:
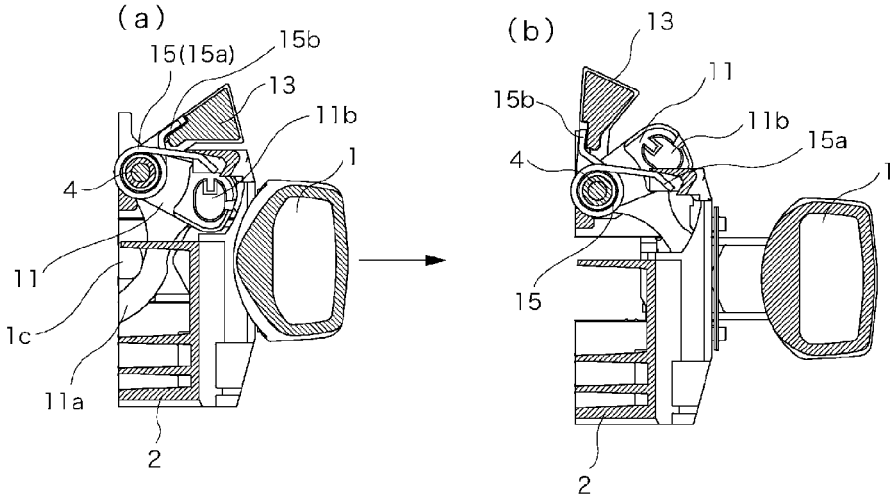
FIG. 3 is a view illustrating how an operating handle operates, Part (a) is a cross-sectional view taken along line 3A-3A of Part (b) of FIG. 2, and Part (b) is a cross-sectional view taken along line 3A-3A of Part (b) of FIG. 2 under a condition where the operating handle is rotated to its actuated position.

The counter weight 13 is locked to the relay lever 11 clockwise in a position illustrated in Part (a) of FIG. 3 and is externally fitted to the relay lever 11 counterclockwise from this position in such a way as to be rotatable independently of the relay lever 11, and the counter weight 13 is provided in order to balance an operating force in a direction in which the door is opened by an inertial force of the operating handle 1 at the time of occurrence of side crash of a vehicle.

In the above-described configuration, when the operating handle 1 is turned from its initial position illustrated by full lines in Part (b) of FIG. 1 to its turned position illustrated by dash-double dot lines therein, the one end of the operating handle 1 moves toward a top surface side in a direction of arrow as illustrated in Part (a) of FIG. 3. (Hereinafter, in the description, with reference to Part (a) of FIG. 1, the left-hand side of the sheet will be described as "front" or "frontward," the upper side thereof will be described as "upward," and this side of the sheet as seen in Part (a) of FIG. 1 will be described as a "top surface.") When the locking portion 1*c* moves in the direction of arrow as the operating handle 1 moves, the relay lever 11 rotates counterclockwise from its initial rotated position illustrated in Part (a) of FIG. 3 and moves to the turned position illustrated in Part (b) of FIG. 3 to actuate the door lock device 14.

A torsion spring 15 is wound around the relay lever 11 in order to bias the relay lever 11 toward the initial position. The torsion spring 15 holds the operating handle 1 in the initial position by applying a bias force in a direction in which the locking portion 1*c* of the operating handle 1 is pressed against the input portion a of the relay lever 11.

As illustrated in FIG. 3, the torsion spring 15 is locked at one leg portion 15*a* as a fixed end to the handle base 2 and at the other leg portion 15*b* as a movable end to the counter weight 13 externally fitted to the relay lever 11, and the bias force of the torsion spring 15 is transmitted via the counter weight 13 to the relay lever 11.

Figure 4:
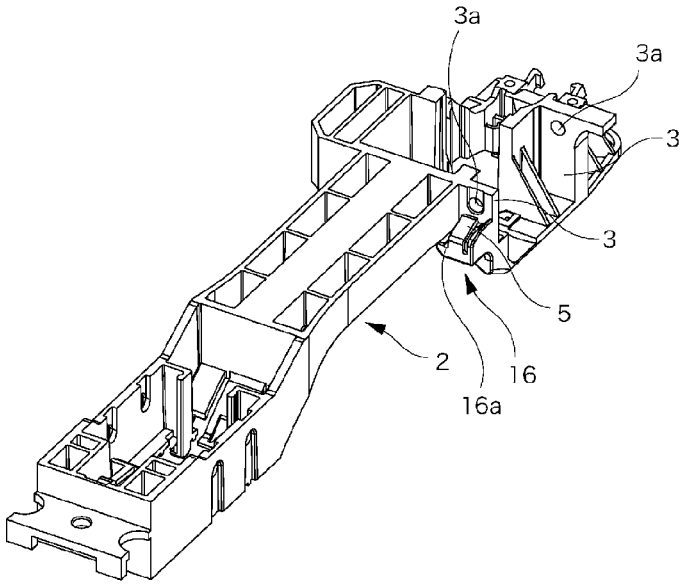
FIG. 4 is a perspective view of a handle base as seen from a direction of a top surface.
Figure 5:
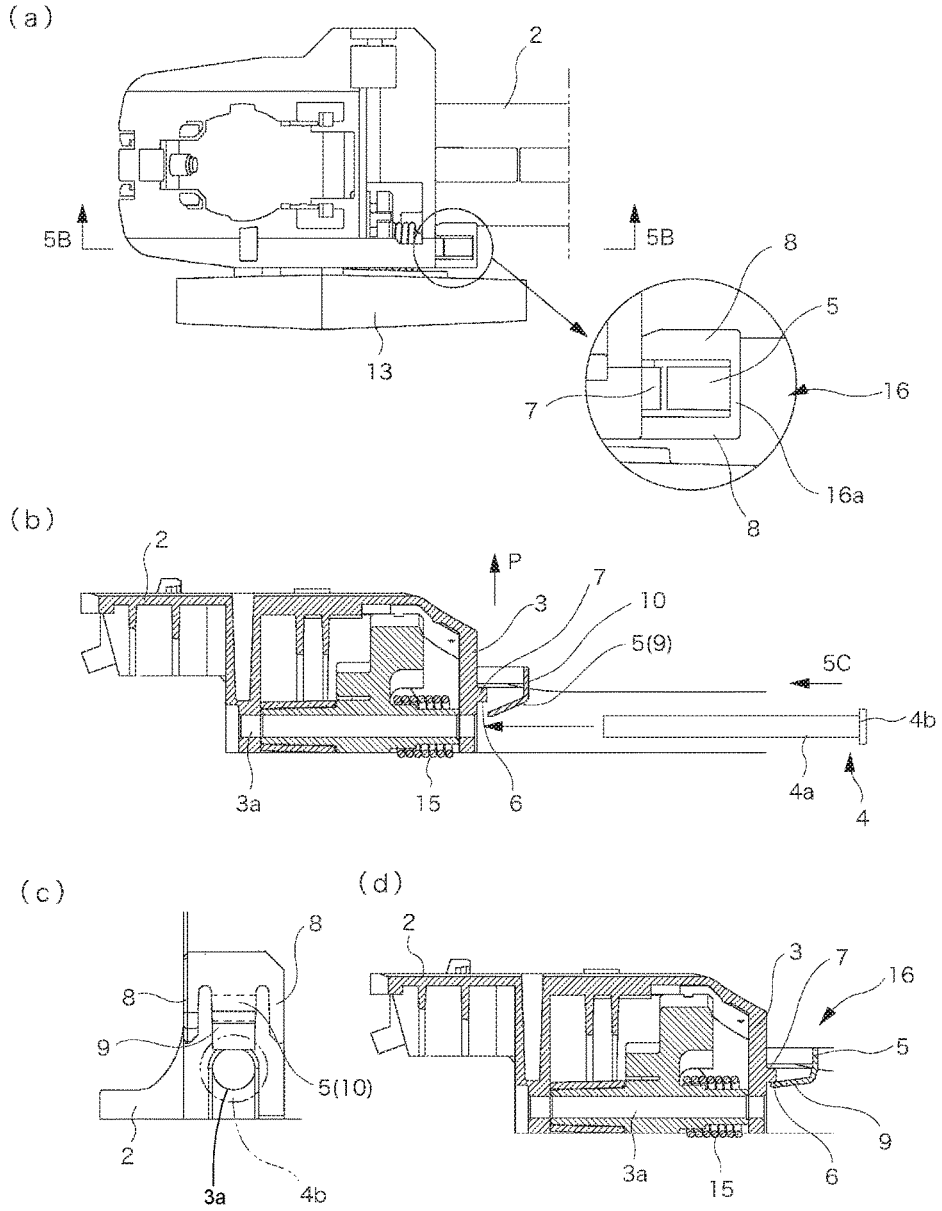
FIG. 5 is a view illustrating a principal part of the present invention, Part (a) is a top view of the handle base, Part (b) is a cross-sectional view taken along line 5B-5B of Part (a), Part (c) is a view taken in a direction of arrow 5C of Part (b), and Part (d) is a cross-sectional view illustrating operation of a stopper portion.
Figure 6:
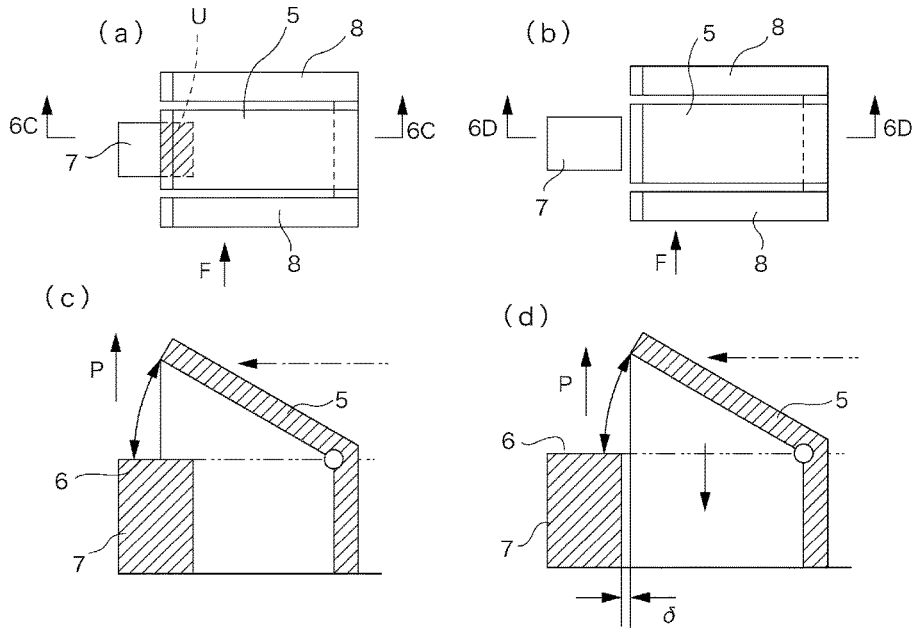
FIG. 6 is a view illustrating operation of the present invention, Part (a) is a front view illustrating the occurrence of an undercut region, Part (b) is a front view illustrating a state in which the undercut region is eliminated by the present invention, Part (c) is a cross-sectional view taken along line 6C-6C of Part (a), and Part (d) is a cross-sectional view taken along line 6D-6D of Part (b).
Figure 7:
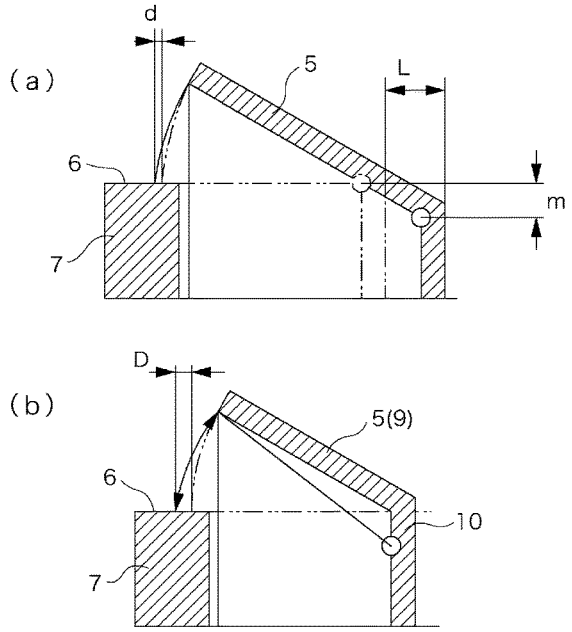
FIG. 7 is a view illustrating operation of the present invention, Part (a) is a cross-sectional view in a case where an elastic piece is configured as a straight beam, and Part (b) is a cross-sectional view in a case where the elastic piece is formed in a bent shape.

FIGS. 4 and 5 illustrate details of a structure of a mounting portion of the pivot shaft 4. As illustrated in FIG. 5, the pivot shaft 4 has a flange-shaped head portion 4*b* on one end of a shaft portion 4*a*, and a through-hole 3*a* through which the shaft portion 4*a* can be inserted is formed in each of a pair of the front and rear bearing portions 3 facing each other and protruding from lower side edges of a front end portion of the handle base 2.

Also, the rear bearing portion 3 is provided with a retainer portion 16 protruding rearward, and an elastic piece 5 and a stopper protrusion portion 7 are formed on the retainer portion 16. The retainer portion 16 is formed in the shape of a frame opening at the top and underside and having a linkage piece 16*a* linking rear end edges of a pair of upstanding walls 8 facing each other, and the elastic piece 5 protrudes frontward from an underside end surface of the linkage piece 16*a* in such a way as to close an opening in the underside of the retainer portion 16.

The elastic piece 5 gradually shifts toward the underside as it is closer to the front, and, as illustrated in Part (c) of FIG. 5, the elastic piece 5 is formed at its free end edge in a bent cross-sectional configuration including an oblique portion 9 formed by an inclined surface extending to a position where the through-hole 3*a* is slightly closed, and an orthogonal proximal end portion 10 having elastic deformation capabilities imparted thereto by further extending a slit to an intermediate portion of the linkage piece 16*a*, the slit separating the oblique portion 9 from a sidewall in order to enable elastic deformation of the oblique portion 9.

Figure 2:
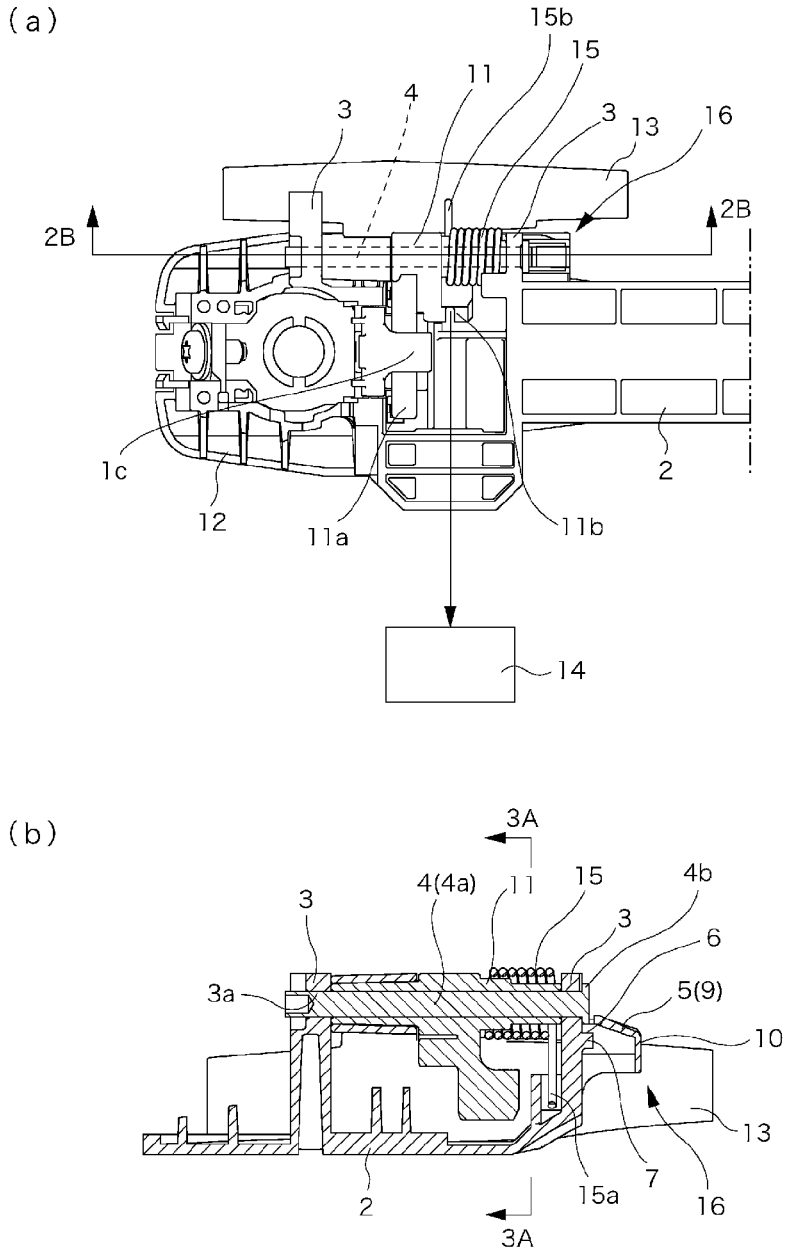
FIG. 2 is a view illustrating a principal part of the present invention, Part (a) is a view taken in a direction of arrow 2A of Part (b) of FIG. 1, and Part (b) is a cross-sectional view taken along line 2B-2B of Part (a) of FIG. 2.

In this embodiment, therefore, attachment of the relay lever 11 is accomplished by inserting the pivot shaft 4 into the through-hole 3*a* with the relay lever 11 held in a predetermined position, as illustrated in Part (b) of FIG. 5. By the insertion of the pivot shaft 4, the elastic piece 5 undergoes slight elastic deformation to allow the passage of the shaft portion 4*a* and then undergoes further elastic deformation during the passage of the flange-shaped head portion 4*b*, and, upon completion of the passage of the flange-shaped head portion 4*b*, the elastic piece 5 is restored to its original position by an elastic restoring force, and then, the elastic piece 5 closes a return path of the flange-shaped head portion 4*b* to restrain the pivot shaft 4 from slipping out, as illustrated in Part (b) of FIG. 2.

Also, the side edges of the elastic piece 5 are sandwiched between the upstanding walls 8 which form sidewalls of the retainer portion 16, and thus, the elastic piece 5 is prevented from being loaded by other components colliding with the elastic piece 5, or the like, so that the elastic piece 5 is prevented from becoming inadvertently damaged.

Meanwhile, the stopper protrusion portion 7 protrudes in a protrusion form from the bearing portion 3 and limits an elastic deformation range of the elastic piece 5 as illustrated in Part (d) of FIG. 5. As illustrated in Part (a) of FIG. 5, a gap, as seen in a direction from the top to the underside, is set between a rear end edge of the stopper protrusion portion 7 and the free end edge, or a front end edge, of the elastic piece 5, and, as indicated by arrow P in Part (b) of FIG. 5, the stopper protrusion portion 7 is prevented from becoming an undercut element in a direction of release of a mold at the time of molding of the handle base 2.

In this embodiment, therefore, even if an excessively high bending load is imposed on the elastic piece 5 by obliquely inserting the pivot shaft 4 or doing the like, the elastic piece 5 abuts on the stopper protrusion portion 7 as illustrated in Part (d) of FIG. 5, and thus, the elastic piece 5 does not undergo excessive bending deformation and is protected from an inadvertent fracture.

Also, a lower end of the orthogonal proximal end portion 10 as a fixed end of the elastic piece 5 is far away from a stopper surface 6 of the stopper protrusion portion 7 toward the underside. Thus, when the elastic piece 5 is elastically deformed, the area of contact of a free end portion of the elastic piece 5 abutting on the stopper surface 6 becomes large to thus prevent the elastic piece 5 from coming off from the stopper protrusion portion 7, thereby improving the reliability of operation.

Further, the gap, as seen in a direction from the top to the underside, is set between the rear end edge of the stopper protrusion portion 7 and the free end edge of the elastic piece 5, and thus, the stopper protrusion portion 7 does not become an undercut element at the time of molding of the retainer portion 16, which in turn eliminates a need to use a core or the like in the mold.

EXPLANATION OF REFERENCE NUMERALS

1 OPERATING HANDLE
2 HANDLE BASE
3 BEARING PORTION
4 SHAFT COMPONENT
5 ELASTIC PIECE
6 STOPPER SURFACE
7 STOPPER PROTRUSION PORTION
8 UPSTANDING WALL
9 OBLIQUE PORTION
10 ORTHOGONAL PROXIMAL END PORTION
11 RELAY LEVER

The invention claimed is:

1. A vehicular handle device, comprising:

a handle base fixed to a vehicle and holding an operating handle; and a shaft component attached to a bearing portion provided in the handle base and including a shaft with a flanged head on one end of the shaft, wherein the bearing portion includes a retainer portion, the shaft is inserted into a through-hole of the bearing portion, the shaft component is retained in the bearing portion by a cantilever-shaped elastic piece formed on the retainer portion and configured to be elastically deformed by the shaft and the flanged head of the shaft component during insertion of the shaft into the through-hole to allow passage of the shaft component, the elastic piece extends in an insertion direction of the shaft component and includes an oblique portion that is oblique to the insertion direction and that extends from an insertion upstream side to a free end at an insertion downstream side, the free end faces the flanged head of the shaft and closes at least a portion of the through hole in a natural posture of the elastic piece such that the shaft component is restrained from moving in a slipping-out direction, the handle base is provided with a stopper protrusion portion which limits an elastic deformation range of the elastic piece by letting the free end of the elastic piece abut on a stopper surface of the stopper protrusion portion, and the retainer portion includes a frame that includes an upstanding wall at a side of the elastic piece which prevents inadvertent contact with the elastic piece.

2. The vehicular handle device according to claim 1, wherein the elastic piece is arranged in such a manner that opposed side edges of the elastic piece are between the upstanding wall and another upstanding wall of the frame; and the stopper protrusion portion is located at a position not overlapping the free end of the elastic piece in the natural posture as viewed from a direction perpendicular to the insertion direction of the shaft component.

3. The vehicular handle device according to claim 2, wherein a distance between a proximal end of the elastic piece and an insertion line of the shaft component has a larger dimension than a distance between the stopper surface and the insertion line of the shaft component.

4. The vehicular handle device according to claim 2, wherein the elastic piece includes an orthogonal proximal end portion extending from a proximal end of the oblique portion to be substantially orthogonal to an insertion line of the shaft component.

5. The vehicular handle device according to claim 1, wherein the operating handle includes one longitudinal end portion joined to the handle base in a turnably-operable manner, and the shaft component pivotally supports a relay lever configured to be turned along with operation of the operating handle.

6. The vehicular handle device according to claim 1, wherein the frame includes another upstanding wall such that the upstanding wall and the another upstanding wall are located at opposite sides of the elastic piece.

* * * * *